United States Patent [19]

Fischer

[11] Patent Number: 4,759,160

[45] Date of Patent: Jul. 26, 1988

[54] PREFABRICATED CONCRETE BUILDINGS WITH MONOLITHIC ROOF, WALL, AND FLOOR MEMBERS

[75] Inventor: Peter A. Fischer, Waco, Tex.

[73] Assignee: Versacon Building Systems, Inc., Tex.

[21] Appl. No.: 854,988

[22] Filed: Apr. 22, 1986

[51] Int. Cl.[4] ..... E04B 7/02

[52] U.S. Cl. ..... 52/91; 52/251

[58] Field of Search ..... 52/90, 91, 22, 250, 52/251, 408, 92, 79.1

[56] References Cited

U.S. PATENT DOCUMENTS

| | | | |
|---|---|---|---|
| 1,293,378 | 2/1919 | Donaldson | 52/91 |
| 2,108,065 | 2/1938 | Kotrbaty | 52/91 |
| 2,592,634 | 4/1952 | Wilson | 52/220 X |
| 3,862,527 | 1/1975 | Peterson | 52/408 X |
| 4,530,193 | 7/1985 | Ochs | 52/408 |

FOREIGN PATENT DOCUMENTS

| | | | |
|---|---|---|---|
| 992188 | 7/1951 | France | 52/91 |
| 1076791 | 5/1953 | France | 52/91 |
| 687615 | 2/1953 | United Kingdom | 52/91 |

*Primary Examiner*—Carl D. Friedman

*Attorney, Agent, or Firm*—Hubbard, Thurman, Turner & Tucker

[57] ABSTRACT

Precast concrete wall panels and monolithic roof members may be fabricated separately and assembled on site to construct buildings of generally rectangular modular configurations having pitched roofs. The basic load bearing shell comprises opposed minimum area vertical concrete wall panels supporting a monolithic roof member comprising an integral deck/joist structure. The roof member includes a generally horizontal extending web portion disposed between opposed sloping web portions. Opposed upward cast projections on the eaves of the roof member form a recess for an insulating roof panel. The roof panels comprise expanded foam insulation sheets bonded to plywood decking for supporting conventional roofing material. The roof panels meet at a central ridge line and form with the horizontal web portion of the roof members a chase for electrical and mechanical components for the building. The wall panels are formed with opposed parallel flanges to form H or I beam cross sectional configurations to increase lateral stability and to provide for joining an interior wall to an outer wall formed by one of the wall panels.

20 Claims, 5 Drawing Sheets

PREFABRICATED CONCRETE BUILDINGS WITH MONOLITHIC ROOF, WALL, AND FLOOR MEMBERS

BACKGROUND OF THE INVENTION

1. Field of the Invention

The present invention pertains to buildings having precast modular floor, wall, and roof members which may be assembled to provide a load bearing shell for a building having the interior and exterior appearance of conventional construction.

2. Background

Various efforts have been made to provide prefabricated buildings, particularly of a type suited as single and multi-family dwellings. Efforts to develop prefabricated housing utilizing wall panels and roof trusses manufactured of conventional building materials and using conventional construction have not been entirely satisfactory and, in order to manufacture components which may be easily assembled at the building site and provide modular designs, the finished appearance of the building is often compromised. Moreover, the manufacture of prefabricated buildings using conventional materials and construction methods has not been particularly cost effective.

There has been a longfelt desire to develop prefabricated building structures, including types suited for single and multifamily residential dwellings as well as low rise commerical buildings, wherein preconstructed wall panels and roof members are utilized and are assembled at the building site to form a shell or enclousre which may be finished out to give the appearance of a conventionally constructed building. The disadvantages of prior art prefabricated building structure include the lack of a suitable prefabricated roof member which incorporates the structural features of the truss, rafters, purlins, cornice and soffit into a single member as well as provide a roof covering which has suitable insulating characteristics. Another disadvantage of most types of prefabricated buildings resides in the fact that interior walls are typically load bearing, particularly if the structure is preassembled in modules at the factory or at the building site and assembled on a foundation. However, the disadvantages and unattractive features of prior art prefabricated buildings and, particularly, prior art types utilizing conventional framing materials and methods have been overcome with the prefabricated building in accordance with the present invention.

SUMMARY OF THE INVENTION

The present invention provides a prefabricated building and components wherein precast floor members, exterior wall members, and roof members are formed of reinforced concrete and ara adapted to be cast in a factory location or at the building site and assembled at the building site to provide a structure which provides a load bearing shell particularly adapted for finishing out the building to produce the aesthetic appeal associated with conventional construction materials and methods.

In accordance with one aspect of the present invention single or multi-family residential dwellings may be fabricated of precast concrete floor slab members, precast vertical wall panels and precast monolithic roof members which may be easily assembled in a way wherein one floor slab member, two vertical wall panels and a roof member comprise a load bearing shell. Alternatively, a single roof member and two vertical wall panels may be set on a prepoured concrete foundation at the building site or roof, wall, and precast floor sections may be preassembled and delivered to the building site. The modular construction of the basic three or four piece load bearing structure provides for erecting buildings of various sizes including single and multi-story buildings.

The basic load bearing precast concrete shell provided by the present invention provides for all non-concrete walls to be less expensive since they are not required to be load bearing and provides for a variety of final finishing out construction to give each building a custom designed and constructed appearance. Moreover, by providing a series of standardized vertical wall panels and roof members which provide a series of standardized openings requiring fill-in pieces or panels, these components may be of standard size and permit prefabrication of the intermediate fill-in pieces of non load bearing wall portions.

In accordance with another aspect of the present invention there is provided a building wherein vertical outside load bearing wall panels are provided which cover a minimum area and are of a configuration wherein a generally U shape or I beam type cross-section is provided having vertically extending flanges, which can serve as the beginning a continuing inner wall fabricated in the conventional manner of other materials. The vertical wall panels may be prefinished or have a cast-in place pattern simulating conventional exterior wall materials. The concrete aggregate may be exposed or the wall may be covered with masonry or wood panelling during fabrication or after erection at the building site.

In accordance with still a further aspect of the present invention there is provided a prefabricated building having a roof structure made up of a plurality of monolithic precast concrete roof members which are configured to provide a support for a unique roof panel characterized by a laminated insulation board and support check or sheet for supporting a conventional roof covering such as composition or wood shingles. The configuration of the roof members together with the roof panels and a relatively inexpensive supporting frame also provides a chase for electrical conduits, plumbing and air conditioning ducts.

The unique aspects of the present invention together with additional superior features and advantages will be further appreciated by those skilled in the art upon reading the detailed description which follows.

DESCRIPTION OF THE PREFERRED EMBODIMENT

Figure 1:
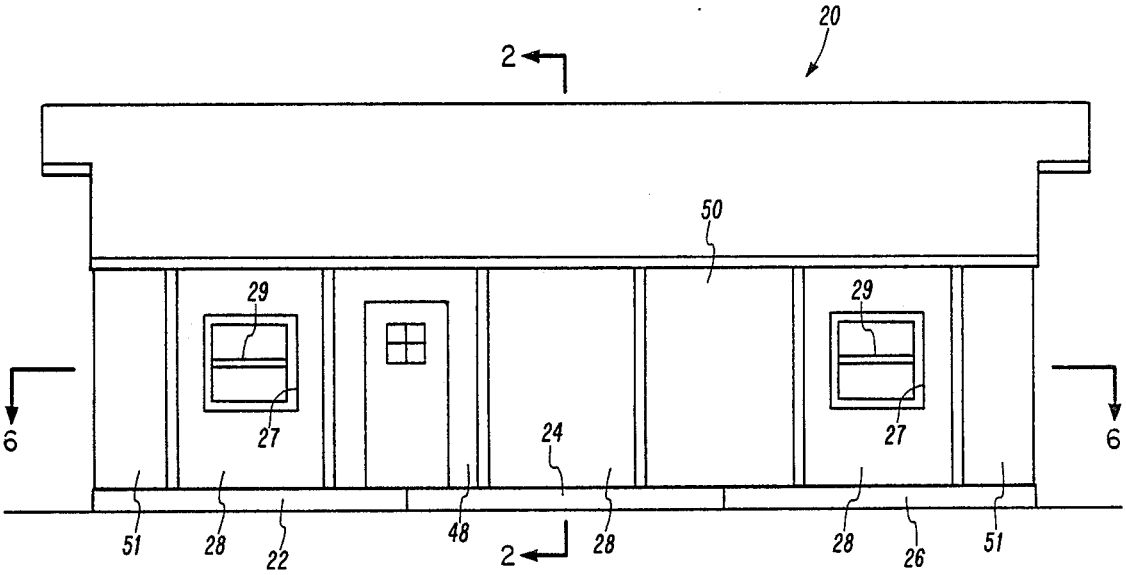
FIG. 1 is a front elevation of a generally rectangular pitched roof residential building or house constructed in accordance with the present invention.

In the description which follows like parts are marked throughout the specification and drawing with the same reference numerals, respectively. The drawing figures are not necessarily to scale and certain features of the invention may be shown exaggerated in scale or in somewhat schematic form in the interest of clarity and conciseness.

Figure 2:
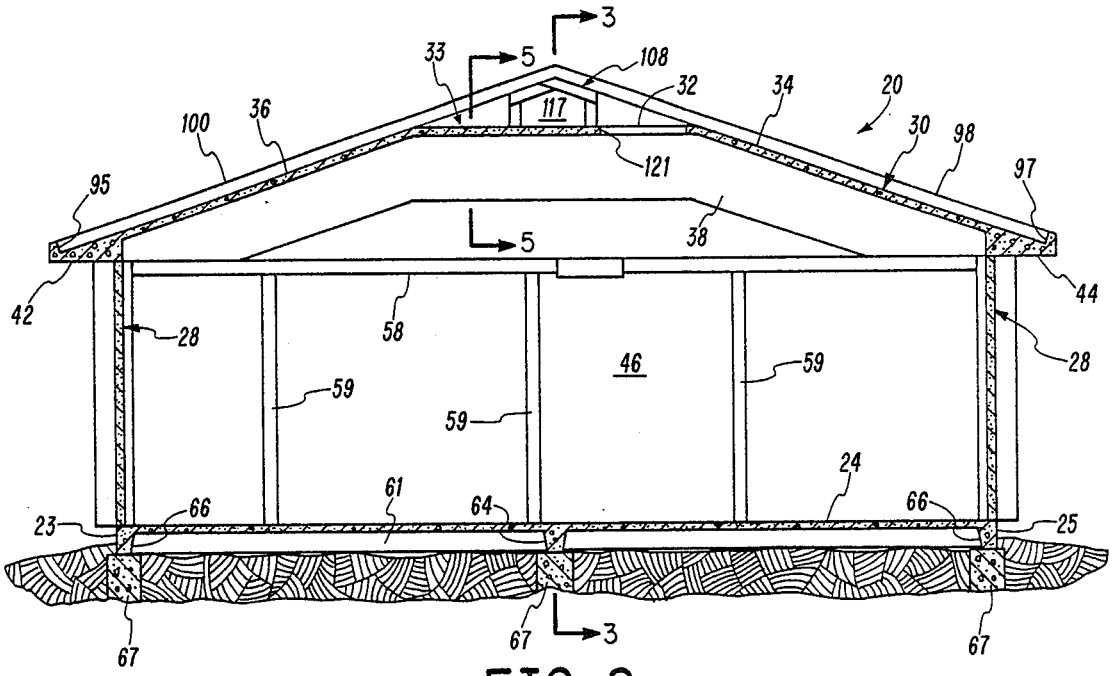
FIG. 2 is a transverse section view taken along the line 2—2 of FIG. 1.
Figure 3:
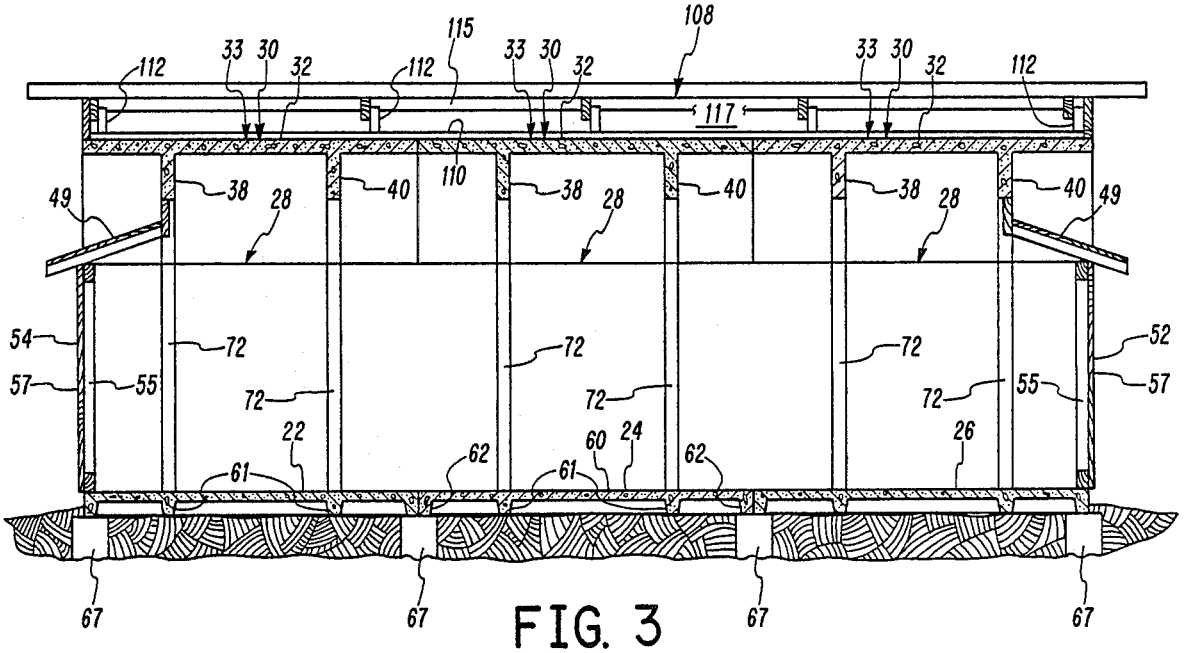
FIG. 3 is a longitudinal section view taken along the line 3—3 of FIG. 2.
Figure 5:
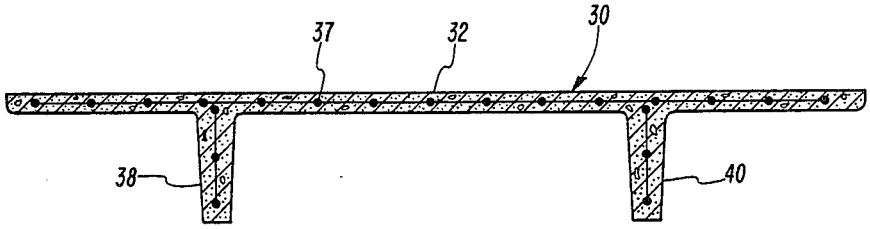
FIG. 5 is a detail section view taken along the line 5—5 of FIG. 2.
Figure 6:
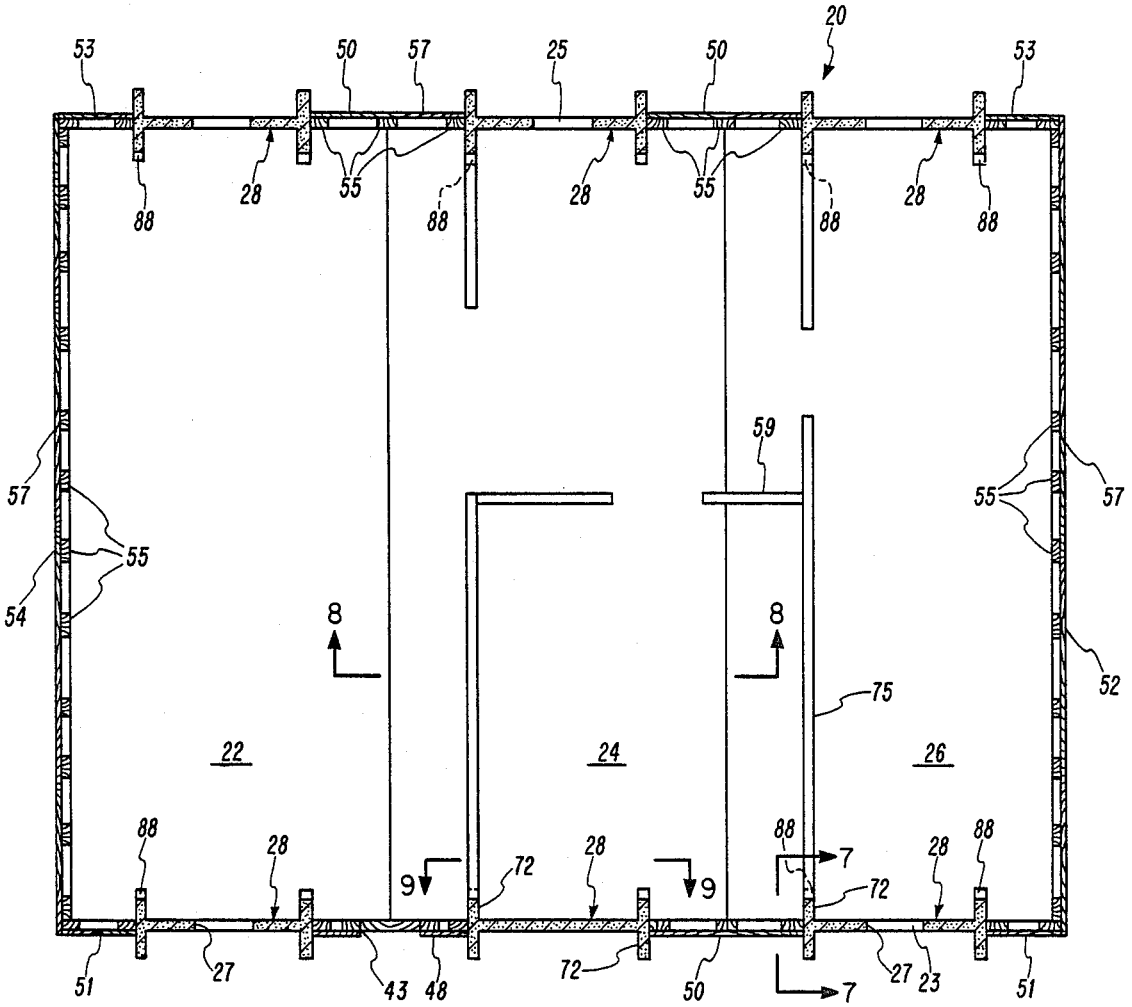
FIG. 6 is a plan view taken along the line 6—6 of FIG. 1.

Referring to FIGS. 1, 2, 3 and 6, the present invention contemplates the provisison of various types of building structures including residential dwelling units such as the generally rectangular pitched roof house, generally designated by the numeral 20. The house 20 comprises a floor structure made up of a plurality of generally rectangular reinforced cast concrete slab members 22, 24 and 26, FIGS. 3 and 6, each of which is adapted to support opposed vertical upstanding precast reinforced concrete wall panels 28. A pair of wall panels 28 is supported on each of the slab members 22, 24 and 26, as illustrated in FIG. 6, in spaced apart aligned relationship along the transverse edges 23 and 25 of the slab members, respectively. As shown in FIGS. 2 and 3, each pair of wall panels 28 supports a monolithic roof member, generally designated by the numeral 30, comprising a precast reinforced concrete beam structure including a generally horizontally extending web portion 32 and opposed sloping web portions 34 and 36, FIG. 2. The roof members 30 are also each characterized by spaced apart integral depending flanges 38 and 40, see FIG. 5 also, which may have bottom edges extending parallel to the surfaces of the web portions 32, 34 and 36 or, alternatively, have bottom edges extending horizontally between opposed integrally formed eave portions 42 and 44, FIG. 2. As indicated in FIG. 5, the roof members 30 are preferably provided with a suitable grid 37 of steel reinforcing rods or bars embedded in the web portions 32, 34 and 36 and the flanges 38 and 40. Accordingly, a pair of wall panels 28 and a roof member 30 form a load bearing shell type enclosure 33, multiples of which may be set side by side, as indicated in FIG. 3, to form the basic load bearing structure for the house 20.

In the embodiment illustrated three shell enclosure units 33 characterized by a slab member 22, 24 and 26, respective spaced apart wall panels 28 for each slab member and a roof member 30 for each pair of wall panels 28 form the entire load bearing structure and the entire roof structure for the house 20. Accordingly, a substantially clear span interior space 46, FIG. 2, is provided for the house 20 which may be subdivided into rooms according to virtually any desired floor plan. Moreover, as illustrated in the drawing figures, various types of conventionally constructed exterior nonload bearing wall sections 48, 50, 51, 52, 53 and 54 may be interposed between the load bearing wall panels 28 to enclose the interior space 46. The wall sections 48, 50, 51, 52, 53 and 54 may, for example, comprise conventional wood studs or column members 55 and exterior panelling 57 and may or may not be prefabricated. The wall section 48 is shown with a doorway 43. The end walls 52 and 54 may include cornice parts 49, FIG. 3, for closing in the space between the end walls and the depending flanges 38 and 40 of the roof members 30. Conventional interior ceiling and wall strucutres 58 and 59, FIG. 2, may be erected and abutted to the wall panels 28.

Figure 8:
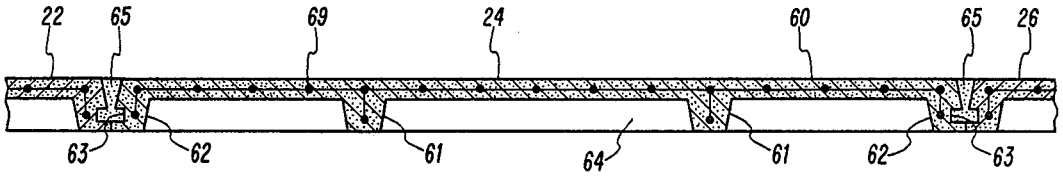
FIG. 8 is a section view of one of the floor slab members taken along the line 8—8 of FIG. 6.

As illustrated in FIGS. 2, 3 and 8, in accordance with a preferred embodiment of the invention, the floor slab members 22, 24 and 26 may each be characterized by generally rectangular reinforced concrete members which, as shown by way of example for the slab member 24, include generally horizontal planar web portions 60 and longitudinally extending reinforcing flanges 61 and 62. As shown in FIG. 8, the opposed flanges 62 may be fabricated such that the outside surfaces of the flanges are provided with recesses 63, respectively, which when abutted to corresponding flanges of the slab members 22 and 26 may be filled with grout 65 to form a continuous interior floor surface. The slab members 22, 24 and 26 may each include transverse reinforcing flanges 64 and 66, FIG. 2. The floor slab members 22, 24 and 26 are also preferably set on previously poured concrete piers 67 set spaced apart to support the flanges 62 as well as the transversely extending end flanges 66, FIG. 2. The slab members 22, 24 and 26 may include a conventional grid of steel reinforcing members 69, FIG. 8, such as a No. 3 steel reinforcing bar set on 12 inch or 18 inch centers in a rectangular grip pattern. The slab members 22, 24 and 26 may be constructed on site or precast and transported to the building site. Alternatively, it will be appreciated fromt he description herein, the slab members 22, 24 and 26 may be formed as a single cast-on-site slab foundation or slab member on which the vertical wall panels 28 are mounted in a prearranged pattern as indicated by the floor plan of FIG. 6.

Figure 9:
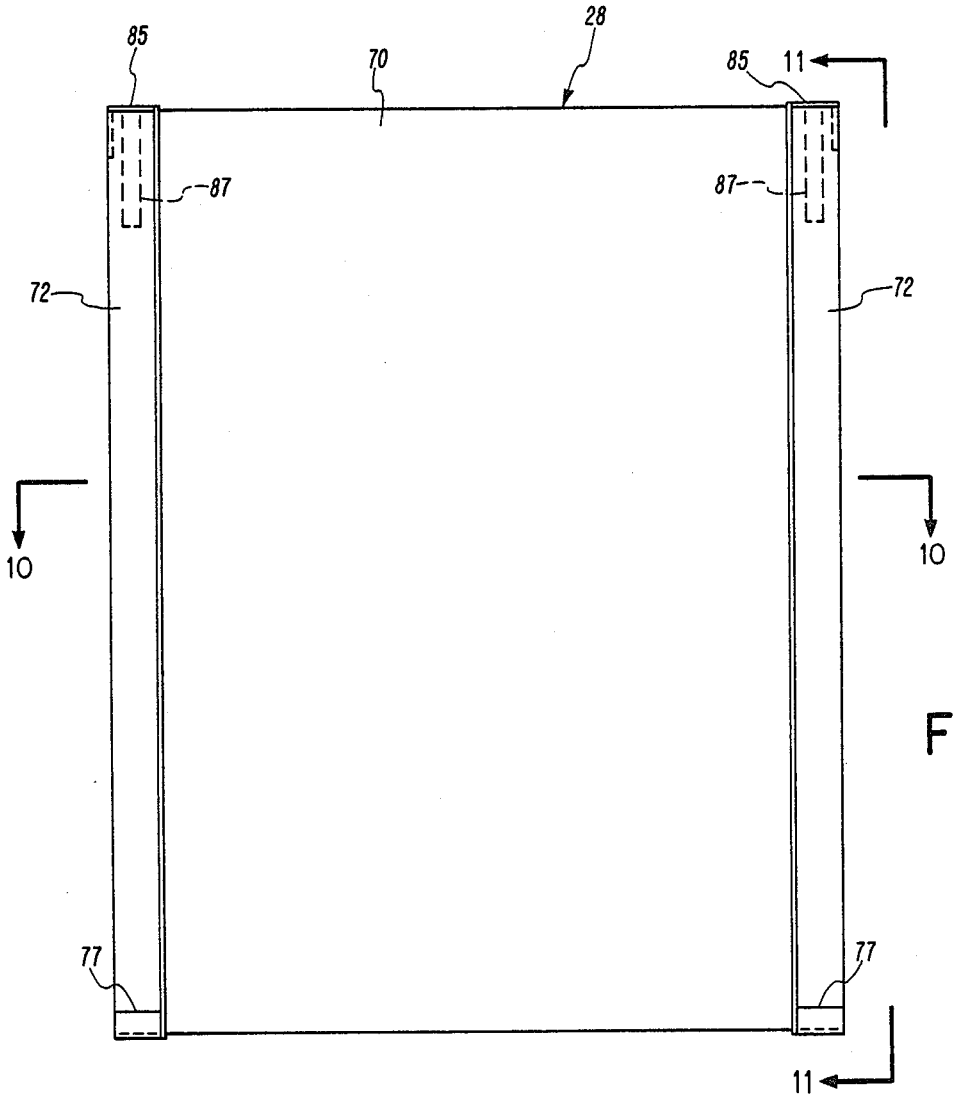
FIG. 9 is an elevation of one of the vertical wall panels taken along the line 9—9 of FIG. 6.
Figure 10:
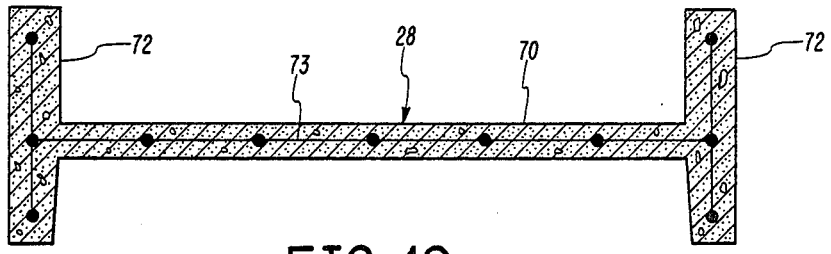
FIG. 10 is a section view taken along the line 10—10 of FIG. 9.
Figure 11:
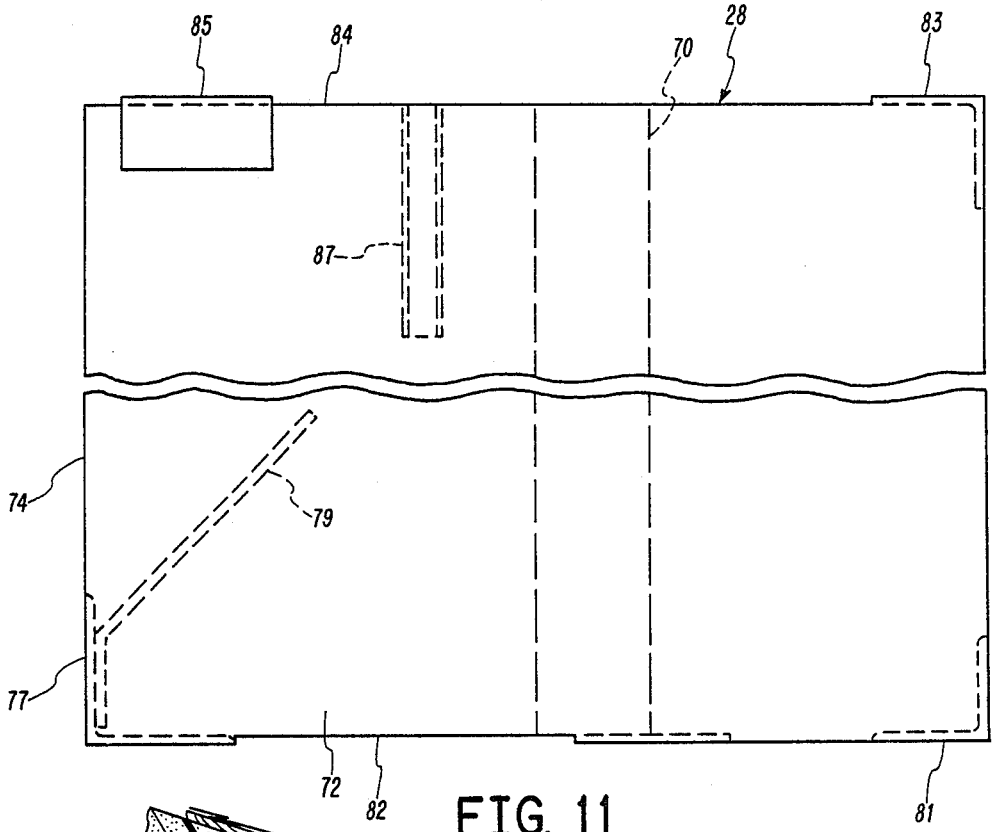
FIG. 11 is a detail view on a larger scale than FIG. 9 and taken along the line 11—11 of FIG. 9.

Referring now to FIGS. 9, 10 and 11, each of the vertical wall panels 28 is preferably formed in either a U shaped cross sectional configuration or, as illustrated, an I or H beam type cross sectional configuration having a central web portion 70 and opposed flanges 72. The flanges 72 may extend on each side of the web 70 or only from one side if interior or exterior projecting portions of the flanges are desired to be eliminated. The wall panels 28 are preferably formed of reinforced cast concrete having a grid 73 of steel reinforcing bars encapsulated in the core of the web 70 and the flanges 72. As shown in FIGS. 9 and 11, the base of each flange 72 is fitted on the inward facing side 74 of the flange with a steel angle section attachment plate 77 having an integral reinforcing rod 79 extending into and encapsulated by the flange 72. Additional cast in place steel reinforcing plates 79 and 81 are formed along the base 82 of the flanges 72 and have an outward facing surface. The top edges 84 of each of the flanges 72 are provided with corner reinforcing plats 83 and 85 and a cast-in-place threaded insert 87.

Figure 7:
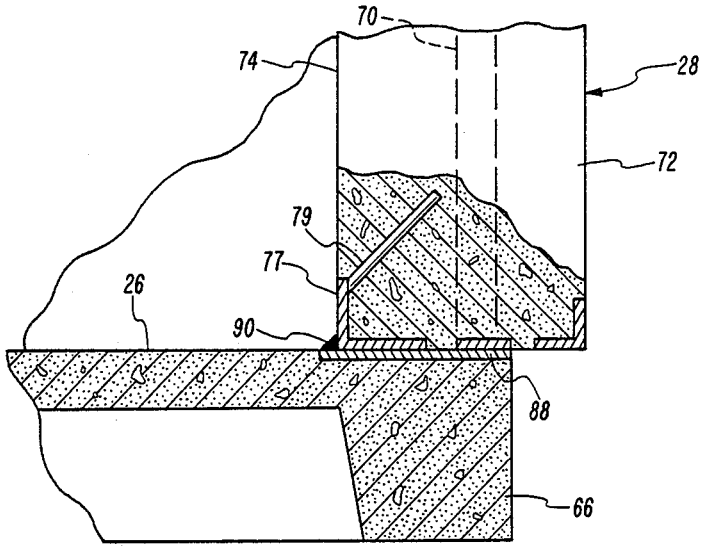
FIG. 7 is a detail section view taken along the line 7—7 of FIG. 6.

Referring to FIG. 7, each of the slabs 22, 24 and 26 is preferably provided with cast in place wall panel mounting plates 88, one shown in FIG. 7, which are spaced apart to match the spacing between the flanges 72 of the wall panels 28. Accordingly, the wall panels 28 are mounted on the mounting plates 88 and suitably attached thereto such as by welding the plates 77 to the mounting plates 88 at 90, FIG. 7, for example, to secure the wall panels in position in accordance with the floor plan of FIG. 6. The flanges 72 are also adapted to form junction points for interior wall partitions 75, as shown by way of example in FIG. 6.

Figure 12:
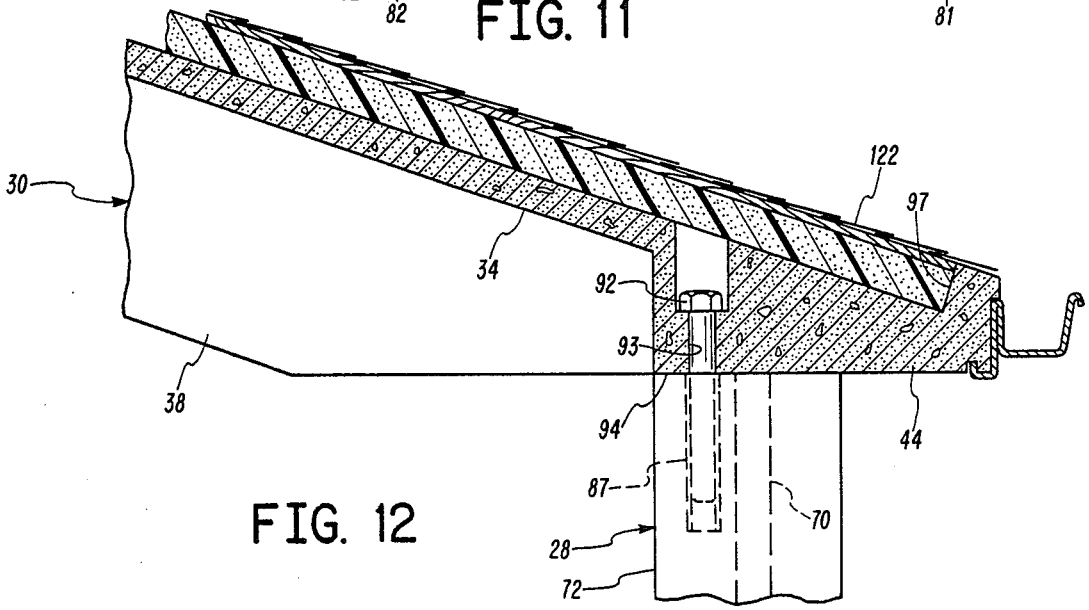
FIG. 12 is a detail view showing the connection between the top of a vertical wall panel and the eave soffit of a roof member.

Referring now to FIGS. 2 and 12, a pair of opposed wall panels 28 support a roof member 30 and are connected thereto, as shown by way of example in FIG. 12, by bolting the roof members to the tops of the wall panels with elongated bolts 92 which are inserted through suitable stepped clearance holes 93 formed in the eave secitons 42 and 44 and wherein the bolts extend into the cast-in-place inserts 87 formed in each of the flanges 72 of the wall panels. Accordingly, once the wall panels 28 are erected on their respective slabs 22, 24 and 26 the respective roof members 30 may be set in place on top of the wall panels and secured thereto in the manner illustrated in FIG. 12 or, alternatively, weld plates may be provided on the surface 94 of the eave section 44 and the corresponding surface of the eave section 42 whereby the roof members 30 may be secured to the wall panels 28 by welding contiguous surfaces of the plates 85 to the aforementioned cast-in-place insert plates on the eave sections 42 and 44.

Figure 4:
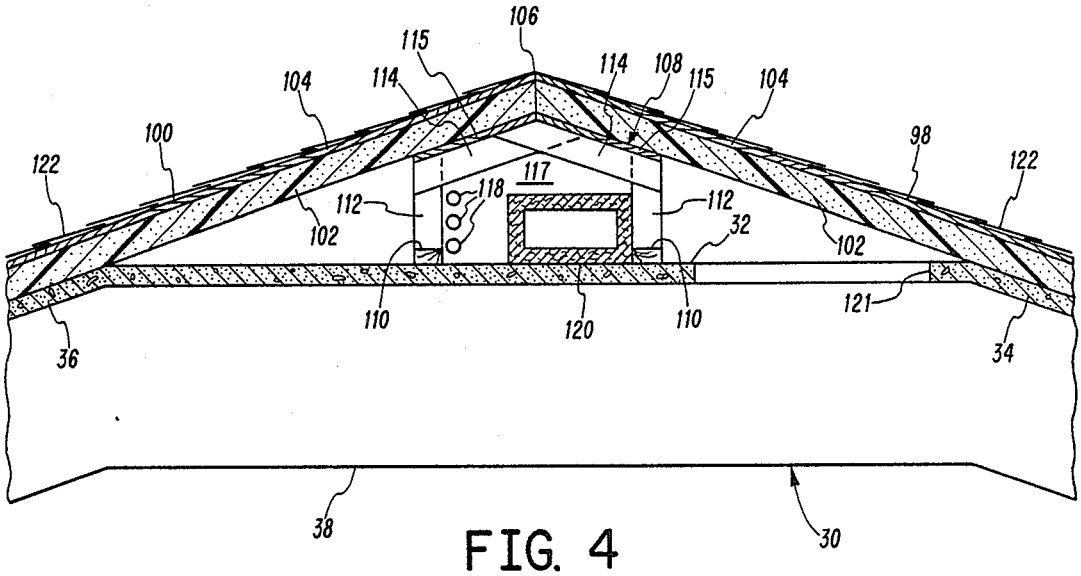
FIG. 4 is a detail view of the roof structure taken along the same line as the view of FIG. 2 but on a larger scale.

In accordance with an important aspect of the present invention thereof members 30 are formed with upwardly projecting edges 95 and 97, FIG. 2, of the respective eave sections 42 and 44, to provide a recess in the top surfaces of the sloping roof web portions 36 and 34, respectively. The sloping web portions 34 and 36 are adapted to support opposed roof panels 98 and 100. Referring also to FIG. 4, the panels 98 and 100 are preferably formed of laminations of expanded plastic foam insulation material 102 which are bonded to an outer relatively rigid deck member 104 formed of plywood sheet or the like. The roof panels 98 and 100 extend to the central roof ridge line 106 ad are also supported by a ridge frame, generally designated by the numeral 108, extending along the horizontal web portions 32 of the roof members 30. The frame 108 is preferably made up of spaced apart elongated wood plates 110 extending parallel to each other and supporting spaced apart wood column members 112. The column members 112 support interconnected rafter members 114. The frame 108 also supports the roof panels 98 and 100 by suitable opposed panels of plywood subdecking 115.

Thanks to the arrangement of the horizontally extending web portions 32 of the roof members 30, the roof panels 98 and 100 and the supporting frame 108 an elongated space 117 is formed along the longitudinal extent of the house 20 to provide a chase for electrical and plumbing conduits such as the conduits 118 and air conditioning duct-work 120, for example. The horizontal web portion 32 of one or more of the roof members 30 may be provided with a suitable man access opening 121, FIGS. 2 and 4, to provide access to the chase 117 for servicing or repair of the conduits, duct-work or other elements disposed therein.

Moreover, due to the configuration of the roof members 30 and the insulated roof panels 98 and 100, the time required to construct a building such as the house 20 may be substantially shortened. Once the wall panels 28 and the roof members 30 are set in place and secured, the entire roof may be finished merely by placing the panels 98 and 100 in position, has indicated in FIGS. 2 and 3, followed by application of conventional roof coverings including composition or wood shingles, such as the shingles 122 illustrated in FIG. 4, and which may be applied directly to the decking 104.

It will be appreciated from the foregoing description that the construction of the house 20, utilizing the structural shell enclosures 33 comprising the wall panels 28 and the roof members 30, provides a building which may include conventional construction materials for finishing out the exterior and interior walls and ceilings, thus giving a visual impression of a completely conventionally constructed building. The construction of the monolithic roof members 30 incorporates in one or more members of like construction all of the elements such as trusses, rafters, cornices and soffit required in conventional construction into only a minimum number of prefabricated members. Moreover, the horizontal web portions 32 of the roof members 30, in combination with the unique roof panel members 98 and 100 and the supporting frame 108, provide a space for housing essentially all of the mechanical and electrical conduits and ducting for the house 20.

Another advantage of the structural features of the house 20 resides in the provision of the wall panels 28 which cover a minimum wall area, are provided with the transverse flange portions 72 which add strength and stability to the panels and can serve as edges of interior walls at the point they join an outer wall. Selected ones of the wall panels 28 may be cast with openings for window and door frames, such as the window openings 27 shown in FIGS. 1, 3 and 6 for receiving window frame assemblies 29, thereby eliminating the cost of framing around such openings as required in conventional construction. The wall panels 28 as well as the interior side of the roof members 30 may be provided with cast-in-place decorative patterns to simulate brick or stone surfaces, for example, or these members may be covered with conventional building materials for aesthetic purposes.

The erection of the house 20 may follow a selected one of alternate procedures including the erection of the wall panels 28 and the roof members 30 on a slab or floor member 22, 24 or 26 which has been cast at the building site. Moreover, the wall panels 28 and the roof members 30 may be erected on precast floor beams, not shown, set on the piers 67. The assembly of a floor slab member 22, 24 or 26 with a pair of wall panels 28 and an associated roof member 30 may be carried out at the building site or preassembled and delivered to the building site depending on the overall size of the three of fourpiece shell assembly forming the enclosure 33. Alternatively, the entire house 20 may also be prefabricated and delivered to the building site. The overall size of a building which may be constructed using the basic load bearing shell structure or enclosure of the present invention may be varied substantially. Moreover, multistory structure may be built utilizing arrangements of wall panels 28 supportive of and connected to intermediate horizontal slab type ceiling/floor members. Additional sets of wall panels 28 may be supported on the slab type ceiling/floor members above the first level of wall panels and supporting, in turn, the roof members 30. The specific overall dimensions of the wall panels 28 and roof members 30 may, of course, be varied while retaining the basic concept of wall panels which span the distance between the parallel flanges 38 and 40 of the roof members 30 and, preferably, span the distance between the integral flanges of floor slab members such as the flanges 61 of the floor slabs 22, 24 and 26.

Although a preferred embodiment of the present invention has been described in detail herein those skilled in the art will also recognize that various substitutions and modifications may be made to the specific structure shown and described without departing from the scope and spirit of the invention as recited in the appended claims.

What is claimed is:

1. A reinforced concrete shell forming at least a portion of a roof and at least two vertical wall panels of a building comprising:

opposed concrete vertical wall panels, said wall panels including means for supporting said wall panels on a foundation member, and means for supporting a roof member between said wall panels; and a separate monolithic concrete roof member adapted to be supported on and spanning the space between said wall panels, said roof member including opposed sloping web portions and at least one depending flange contiguous with said web portions in supportive relationship thereto, and an integrally cast generally horizontally extending web portion extending between said sloping web portions to provide a clearance space between a roof covering and said horizontal web portion.

2. The combination set forth in claim 1 wherein:

said roof member includes integral cast concrete eave sections delimiting the lower edges of said sloping web portions, respectively.

3. The combination set forth in claim 1 wherein:

said wall panels each include vertically extending flange means aligned with said at least one flange of said roof member.

4. The combination set forth in claim 1 including:

a roof covering comprising opposed roof panels of laminated layers of foam insulation and an outer deck sheet of said roof panels forming a surface for attachment or roof covering matrial, said roof panels being disposed on said sloping web portions and overlying said horizontal web portion to form a closure for said clearance space.

5. The combination set forth in claim 4 including:

a roof ridge support frame for said roof panels disposed on said horizontal web portion and forming a chase for conduit means for said building.

6. The combination set forth in claim 4 wherein:

said roof member includes integral cast concrete eave sections including upwardly extending projections forming recesses for receiving a lower edge of said roof panels, respectively.

7. A modular building comprising:

foundation means for supporting vertical side and end walls;

plural pairs of opposed cast concrete vertical exterior wall panels supported along opposite sides of said foundation means; and a cast concrete roof member supported on, and spanning without intermediate support from said foundation means, the space between each pair of exterior wall panels, each roof member including opposed, downwardly and outwardly sloping outer side portions and an intermediate, generally horizontal upper side portion extending between upper end portions of said outer side portions, defining the uppermost portion of said roof member, and being aligned with and adjacent to corresponding side portions of another roof member to form a substantially continuous roof deck of said building, said roof members and said pairs of wall panels forming a load bearing exterior shell enclosure of said building that defines an essentially unobstructed interior space of said building which is bounded by said roof members, said wall panels, and said foundation means, and may be partitioned entirely by nonload bearing interior walls

8. The building set forth in claim 7 wherein:

said foundation means comprises at least one generally planar cast concrete floor slab member extending betwene and supportive of each pair of said wall panels.

9. The building set forth in claim 7 further comprising:

nonload bearing walls partitioning portions of said interior space of said building.

10. A modular building comprising:

foundation means for supporting vertical side and end walls;

plural pairs of opposed cast concrete vertical exterior wall panels supported spaced apart along opposite sides of said foundation means;

a cast concrete roof member supported on and extending between each pair of exterior wall panels, each roof member including opposed sloping web portions and an intermediate generally horizontal web portion aligned with and adjacent to corresponding web portions of another roof member to form a substantially continuous roof deck of said building and wherein said roof members and said pairs of wall panels form a load bearing shell enclosure of said building; and nonload bearing wall members interposed between said wall panels and enclosing an interior space of said building, said roof members each comprising a cast concrete monolithic member forming said sloping web portions and horizontal web portion and including spaced apart vertically depending flanges extending between said sloping web portions.

11. The bulding set forth in claim 10 wherein:

said roof members each include generally horizontal web portions extending between said sloping web portions, and said building includes opposed roof panels overlying said sloping web portions and said horizontal web portions and forming an enclosed space extending along and below the roof ridge.

12. In a building adapted to be used as a residential dwelling:

a load bearing shell formed by opposed spaced apart concrete vertical wall panels supporting a concrete roof member therebetween, said roof member including opposed sloping web portions, a generally horizontal web portion intermediate said sloping web portions, spaced apart vertical flanges contiguous with said sloping web portions and opposed eave sections integral with said sloping web portions, respectively, and opposed roof panels overlying said web portions and extending to a ridge line of said building, said roof panels comprising a laminate of insulating material and roof decking for said building.

13. The building set forth in claim 12 wherein:

said sloping web portions, said horizontal web portion, said eave sections and said flanges are cast integral to form a monolithic roof member.

14. The building set forth in claim 12 wherein:
said eave sections include upwardly projecting edges forming recesses for supporting a lower transverse edge of said roof panels, respectively.

15. A prefabricated modular building formed by a plurality of side by side precast reinforced concrete shell enclosures, each of said shell enclosure including:
a pair of spaced apart vertical cast concrete wall panels, each of said wall panels including a center web portion and opposed integral flanges extending normal to said center web portion; and
a roof member extending between and supported by said wall panels, said roof member comprising opposed sloping web portions, each of said sloping web portions extending to an integral cast eave section supported on respective ones of said wall panels of a pair of wall panels, said eave sections including upwardly extending projections forming recesses for receiving and supporting a lower edge of the roof panels, respectively; and
foundation means for supporting said plurality of enclosures side by side to form a load bearing shell of said building.

16. The building set forth in claim 15 wherein:
said foundation means comprises a reinforced cast concrete floor slab member for supporting said wall panels of each pair of wall panels, respectively.

17. The building set forth in claim 15 wherein:
said roof members each include a generally horizontal web portion extending between said sloping web portions and spaced apart depending flanges aligned with said flanges of said wall panels, respectively.

18. The building set forth in claim 15 including:
opposed roof panels overlying and supported by said sloping web portions, said roof panels being formed of a laminate of a layer of heat insulating material and a substantially rigid deck sheet for supporting roof covering material.

19. The building set forth in claim 18 including:
a roof ridge support frame disposed on said horizontal web portions and extending along the roof ridge line of said building for supporting said roof panels at the ridge line of said roof and to form a chase for said building between said horizontal web portions and said roof panels.

20. A modular building comprising:
foundation means for supporting vertical side and end walls;
plural pairs of opposed cast concrete vertical exterior wall panels supported spaced apart along opposite sides of said foundation means;
a cast concrete roof member supported on and extending between each pair of exterior wall panels, each roof member including opposed sloping web portions and an intermediate generally horizontal web portion aligned with and adjacent to corresponding web portions of another roof member to form a substantially continuous roof deck of said building, wherein said roof members and said pairs of wall panels form a load bearing shell enclosure of said building, and wherein said roof members each comprise a cast concrete monolithic member forming said sloping web portions and horizontal web portion and including spaced apart vertically depending flanges extending between said sloping web portions, and further wherein said building includes opposed roof panels overlying said sloping web portions and said horizontal web portions and forming an enclosed spaced extending along and below the roof ridge, and said roof panels comprise laminated layers of plastic foam insulation and an outer decking formed of material for supporting a roof covering; and
nonload bearing wall members interposed between said wall panels and enclosing an interior space of said building.

* * * * *